US007913896B2

(12) United States Patent
Reinkensmeyer

(10) Patent No.: US 7,913,896 B2
(45) Date of Patent: Mar. 29, 2011

(54) BOARD BLANK FOR PRODUCING A PACKAGING CORNER, AND PACKAGING CORNER

(75) Inventor: Horst Reinkensmeyer, Herford (DE)

(73) Assignee: Emsize AB (SE)

( * ) Notice: Subject to any disclaimer, the term of this patent is extended or adjusted under 35 U.S.C. 154(b) by 27 days.

(21) Appl. No.: 11/942,355

(22) Filed: Nov. 19, 2007

(65) Prior Publication Data

US 2008/0083632 A1 Apr. 10, 2008

Related U.S. Application Data

(63) Continuation of application No. PCT/DE2006/000863, filed on May 18, 2006.

(30) Foreign Application Priority Data

May 19, 2005 (DE) ..... 20 2005 008 089 U

(51) Int. Cl.
*B65D 5/50* (2006.01)
*B65D 81/05* (2006.01)

(52) U.S. Cl. ..... 229/199; 206/586

(58) Field of Classification Search ..... 229/199; 206/486, 586, 587, 591, 592
See application file for complete search history.

(56) References Cited

U.S. PATENT DOCUMENTS

| | | | | |
|---|---|---|---|---|
| 3,143,937 | A | 8/1964 | Martin | |
| 3,221,973 | A * | 12/1965 | Kalbrener | 206/591 |
| 3,443,684 | A * | 5/1969 | Taylor | 206/586 |
| 3,482,759 | A * | 12/1969 | Ortiz | 206/586 |
| 3,690,222 | A | 9/1972 | Schroeder | |
| 3,832,826 | A * | 9/1974 | Ullman | 53/473 |
| 3,843,038 | A * | 10/1974 | Sax | 206/586 |
| 3,949,152 | A | 4/1976 | Floessel | |
| 3,957,196 | A | 5/1976 | Kellerman | |

(Continued)

FOREIGN PATENT DOCUMENTS

EP 0621194 10/1994

(Continued)

OTHER PUBLICATIONS

International Search Report and Written Opinion from PCT/US2009/049602 dated Aug. 25, 2009 (copy attached).

(Continued)

*Primary Examiner* — Gary E Elkins
(74) *Attorney, Agent, or Firm* — Workman Nydegger

(57) ABSTRACT

A board blank for producing a packaging corner has at least three parallel strips which are arranged next to one another and are connected to one another. A central strip of the three strips is connected to a first outer strip of the three strips by grooved portions along a first line. Cuts are made between the central strip and the first outer strip between the grooved portions. A profile of the cuts deviates from the first line in a manner extending into the central strip. The central strip and a second outer strip of the three strips are connected by a score in the board along a second line.

3 Claims, 1 Drawing Sheet

U.S. PATENT DOCUMENTS

| | | | | | |
|---|---|---|---|---|---|
| 4,027,817 | A | | 6/1977 | Fremion | |
| 4,094,451 | A | | 6/1978 | Wescoat | |
| RE30,325 | E | | 7/1980 | Waldbauer | |
| 4,215,522 | A | * | 8/1980 | Clift et al. | 53/370.6 |
| 4,264,200 | A | | 4/1981 | Tickner et al. | |
| 4,399,915 | A | * | 8/1983 | Sorenson | 206/586 |
| 4,522,016 | A | | 6/1985 | Dirico | |
| 4,608,038 | A | | 8/1986 | Virta et al. | |
| 4,838,468 | A | | 6/1989 | Lesse | |
| 4,972,954 | A | * | 11/1990 | Dickie | 206/592 |
| 5,058,872 | A | | 10/1991 | Gladow | |
| 5,115,625 | A | | 5/1992 | Barbulesco et al. | |
| 5,374,326 | A | | 12/1994 | Marchetti | |
| 5,823,352 | A | * | 10/1998 | Mena et al. | 206/721 |
| 5,836,498 | A | | 11/1998 | Turek | |
| 5,975,303 | A | * | 11/1999 | Morell | 206/586 |
| 6,012,587 | A | * | 1/2000 | McCullough | 206/586 |
| 6,016,904 | A | | 1/2000 | Hammock et al. | |
| 7,100,811 | B2 | | 9/2006 | Pettersson et al. | |
| 2002/0011171 | A1 | | 1/2002 | Usui | |
| 2005/0121356 | A1 | * | 6/2005 | Wisecarver | 206/586 |
| 2007/0145664 | A1 | | 6/2007 | Sardella | |
| 2007/0199648 | A1 | * | 8/2007 | Hulverscheidt | 156/252 |

FOREIGN PATENT DOCUMENTS

| | | |
|---|---|---|
| GB | 2079802 | 1/1982 |
| JP | 11-157569 | 6/1999 |
| KR | 20-0251839 | 11/2001 |

OTHER PUBLICATIONS

International Search Report and Written Opinion from PCT/US2009/054147 dated Aug. 18, 2009 (copy attached).

International Search Report and Written Opinion from PCT/US2009/065552 dated Nov. 23, 2009 (copy attached).

International Search Report and Written Opinion from PCT/US2009/064477 dated Nov. 13, 2009 (copy attached).

International Search Report from PCT/US2009/064248 dated Dec. 29, 2009 (copy attached).

International Search Report and Written Opinion from PCT/US2010/022983 dated Feb. 3, 2010 (copy attached).

International Search Report and Written Opinion from PCT/US2010/031017 dated Jun. 28, 2010.

* cited by examiner

BOARD BLANK FOR PRODUCING A PACKAGING CORNER, AND PACKAGING CORNER

CROSS-REFERENCE TO RELATED APPLICATION

This application is a continuation, under 35 U.S.C. §120, of copending international application PCT/DE2006/000863, filed May 18, 2006, which designated the United States; this application also claims the priority, under 35 U.S.C. §119, of German patent application DE 20 2005 008 089.6, filed May 19, 2005; the prior applications are herewith incorporated by reference in their entirety.

BACKGROUND OF THE INVENTION

Field of the Invention

The present invention relates to a board blank for producing a packaging corner and to a packaging corner produced from a blank of this type.

Packaging corners are used in order to protect items of furniture which are to be shipped from damage. To this end, the packaging corners are placed on edges of the items of furniture. As a result, the edges are protected against external effects.

However, packaging corners are also used for more than this. For example, packaging corners are suitable for stabilizing stacked, soft materials, such as packed sliced bread, on pallets. The sliced bread is usually placed on pallets in cardboard boxes and wrapped or welded in film. Board corners are used in order that the cardboard boxes and also the sliced bread are not destabilized and deformed in the process.

The packaging corners which are currently used are produced from board blanks, individual elements of the blank being adhesively bonded to one another, in order to prevent the packaging corners from falling apart. After cutting to size and folding, the adhesive bonding of the packaging corners requires an additional operating step, which makes the production of the packaging corners more expensive.

SUMMARY OF THE INVENTION

It is accordingly an object of the invention to provide a packaging corner, which overcomes the above-mentioned disadvantages of the heretofore-known devices and methods of this general type and which provides for a packaging corner that has sufficient stability without adhesive bonding. Furthermore, the invention is based on the object of proposing a blank for a packaging corner of this type.

With the foregoing and other objects in view there is provided, in accordance with the invention, a board blank for producing a packaging corner, comprising:

at least three mutually parallel strips, disposed next to one another connected to one another;

the three strips including a central strip and a first outer strip connected to the central strip by way of grooved sections along a first line;

cuts formed between the grooved sections, between the central strip and the first outer strip;

the cuts following a profile deviating from the first line to protrude into the central strip; and the three strips including second outer strip connected to the central strip via a scoring of the board along a second line.

The blank is particularly suitable for folding to a packaging corner wherein the first outer strip is angled away along the first line by approximately 90° with respect to the central strip, with regions delimited by the first line and the cuts forming tabs, and wherein the second outer strip is angled away along the second line by approximately 180° with respect to the central strip, and wherein a free edge of the second outer strip opposite the second line bear positively against the tabs.

In other words, a blank according to the invention has at least three parallel strips which are arranged next to one another and are connected to one another. A central strip of the three strips is connected to a first outer strip of the three strips via grooved sections along a first line. Here, cuts are made between the grooved sections, between the central strip and the first outer strip. The profile of the cuts deviates from the first line in a manner which protrudes into the central strip. The central strip and a second outer strip of the three strips are connected via a scoring of the board along a second line.

The U-shaped cuts can begin and end on the first line. They can extend parallel to the first line, for example, in a first section. In addition, they can extend in two further sections at a right angle to the first line. In a blank according to the invention, these further blanks can extend from the first line to the first section.

In addition to the three above-mentioned strips, a blank according to the invention can also comprise a fourth strip which preferably adjoins the first outer strip.

The corrugation of the cardboard can extend perpendicularly or parallel to the first or second line. The blank can be produced from solid board, single-layer or multiple-layer corrugated board, endless corrugated board, web-fed corrugated board and other comparable materials which are suitable for this purpose, for example from plastic. As a result of the use of the fourth strip or optionally further additional strips, U-profiles or tube profiles and protective angles or corners can also be produced.

The blank can have one or more perforations transversely with respect to the first line. It is therefore possible to produce the blanks, for example, from what is known as zigzag endless corrugated board and to store them on a pallet as an endless blank. Sections of the endless blank can be separated later along the perforations, in order to be folded and used individually.

For example, a packaging corner according to the invention can be produced from the abovementioned blank in such a way that the first outer strip is angled away along the first line by approximately 90° with respect to the central strip. As a result, the regions which are delimited by the first line and the U-shaped cuts form opened-out tabs. In a packaging corner according to the invention, the second outer strip is angled away along the second line by approximately 180° with respect to the central strip, that free edge of the second outer strip which lies opposite the second line bearing positively against the tabs. This bearing contact is selflocking and can be released only by the action of external forces. Stabilization of the packaging corner is therefore possible without further additives, such as adhesive.

Other features which are considered as characteristic for the invention are set forth in the appended claims.

Although the invention is illustrated and described herein as embodied in board blank for producing a packaging corner, and a packaging corner, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
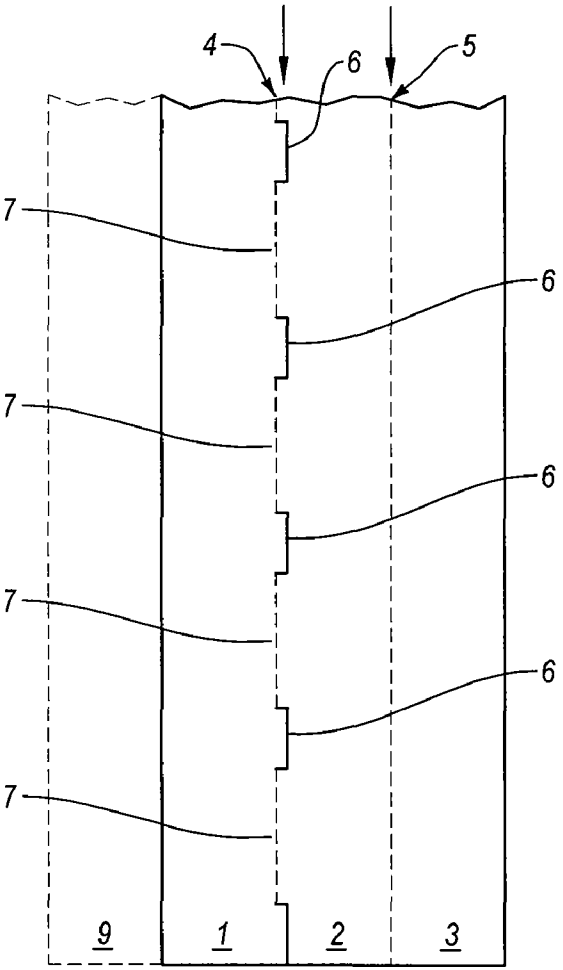
FIG. 1 shows a plan view of a part of the blank according to the invention.

Referring now to the figures of the drawing in detail and first, particularly, to FIG. 1 thereof, the blank according to the invention is produced from an approximately rectangular cardboard piece. The blank comprises three strips 1, 2, 3 which are arranged in parallel and next to one another. The three strips 1, 2, 3 are denoted in the following text as a central strip 2, as a first outer strip 1, and as a second outer strip 3. Here, the central strip 2 is connected to the two outer strips 1, 3.

The connection between the central strip 2 and the first outer strip 1 exists along a first line 4. Sections 7, in which the board is grooved, are provided along the line 4. In each case U-shaped cuts 6 or incisions 6 are provided between these sections, which U-shaped cuts 6 begin at one end of one section 7, extend a small distance perpendicularly with respect to the first line 4, then bend away by 90° to extend parallel to the first line 4, then bend away again by 90° to meet the first line 4 again at an angle of 90° and adjoin the next section 7.

The connection between the central strip 2 and the second outer strip 3 is produced via a scoring along a second line 5. In addition to strips 1-3, a blank as described herein can also comprise a fourth strip 9 adjoining first outer strip 1.

Figure 2:
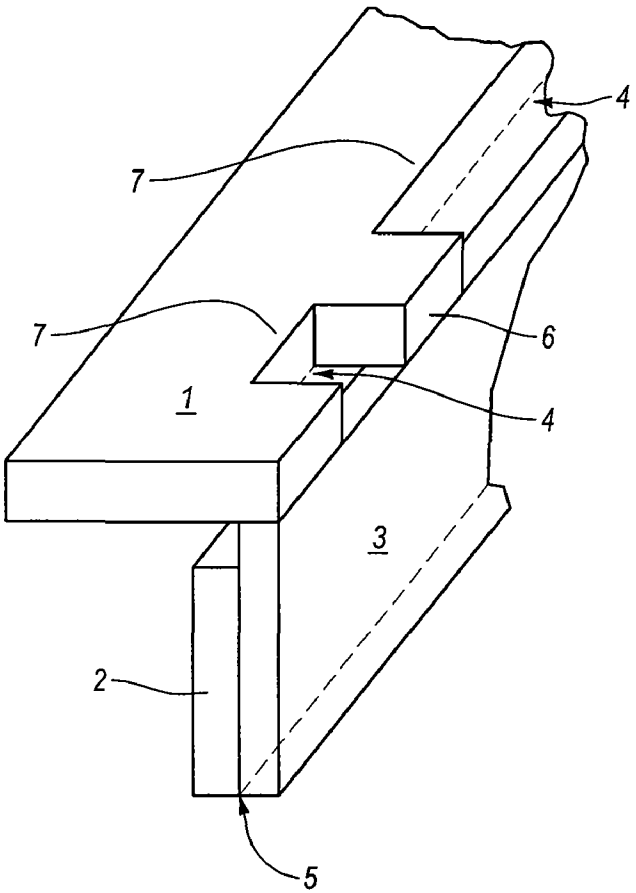
FIG. 2 is a perspective view of a part of the packaging corner.

In order to produce the packaging corner 4 which is shown in FIG. 2, the first outer strip is bent away along the first line 4 by 90° with respect to the central strip 2. Here, the regions which are enclosed by the U-shaped cuts 6 and the first line 4 are opened out as tabs.

Subsequently, the second outer strip 3 is angled away by 180° with respect to the central strip 2 (i.e., it is folded back onto the strip 2), and the free edge which lies opposite the second line 5 bears positively against the tabs and is held clamped by the tabs.

The invention claimed is:

1. A packaging corner formed from a board, the packaging corner comprising:

a bent board, said bent board defining at least three strips, wherein said at least three strips are mutually parallel in a first direction and further:

are disposed next to one another;

are at least partially integrally connected to one another; and include:

a central strip having a first interior edge and a second interior edge that are parallel to each other in the first direction;

a first outer strip connected to said central strip by way of grooved sections along a first line at said first interior edge, said first outer strip further including a first exterior edge parallel to said first interior edge, wherein said first outer strip is angled away along said first line by approximately 90° in a second direction with respect to said central strip; and a second outer strip connected to said central strip via a scoring of said bent board along a second line at said second interior edge, said second outer strip further including a second exterior edge parallel to said second interior edge in said first direction, such that said second outer strip and said first outer strip are separated by said central strip, wherein said second outer strip is angled away along said second line by approximately 180° in said second direction with respect to said central strip; and a plurality of tabs, wherein all tabs of said bent board are integrally formed along said first interior edge and as part of said first outer strip, and with regions delimited by said first line and said cuts forming said plurality of tabs, wherein said plurality of tabs start at said first line and correspond to openings deviating into said central strip, and wherein said plurality of tabs are formed by a plurality of cuts between said central strip and said first outer strip, said cuts following a profile deviating from said first line to protrude into said central strip and wherein said plurality of tabs lock said bent board into a folded position by bearing against a free edge of said second outer strip opposite said second line.

2. A board blank for defining a packaging corner, the board blank comprising:

a board, wherein said board consists of:

a central strip, said central strip having a first interior edge and a second interior edge, said first interior edge being parallel to said second interior edge, and said first interior edge being grooved and said second interior edge being straight;

a first outer strip parallel to, and at least partially integrally connected to said central strip, said first outer strip mating with said central strip along said grooved first interior edge, said first outer strip including a first exterior edge parallel to said first interior edge, and said first exterior edge being straight;

a second outer strip parallel to, and at least partially integrally connected to said central strip, said second outer strip mating with said central strip along said straight second interior edge, said second outer strip including a second exterior edge parallel to said second interior edge, and said second exterior edge being straight; and a plurality of locking tabs, wherein each of said plurality of locking tabs are integrally formed within said first outer strip and along said grooved first interior edge, wherein said plurality of locking tabs are configured to lock said board into an L-shape by bearing positively against said second exterior edge of said second outer strip.

3. A packaging corner produced from a board blank, the packaging corner comprising:

a folded board blank having an upper surface, a lower surface, and a side edge surface extending around a perimeter of said folded board blank, comprising:

a central strip;

a first outer strip, at least partially integrally connected to said central strip, wherein:

said first outer strip is parallel to said central strip and said central strip is rotated approximately 90° relative to said first outer strip, and towards a lower surface of said first outer strip, said first outer strip and said central strip adjoining along a first fold line; and said first outer strip defines a plurality of tabs, wherein said plurality of tabs of said first outer strip are the only tabs on said folded board blank; and a second outer strip at least partially integrally connected to said central strip, wherein said second outer strip is parallel to said first outer strip and said central strip, and is rotated approximately 180° relative to said central strip, said second outer strip and said central strip adjoining along a second fold line, wherein said folded board blank is secured into a folded position by a lower surface of said folded board blank, at said plurality of tabs, positively engaging against a side edge surface of said folded board blank, at said second outer strip.

* * * * *